US005360112A

United States Patent [19]

Beauchamp

[11] Patent Number: 5,360,112

[45] Date of Patent: Nov. 1, 1994

[54] DEVICE FOR USE WITH PALLETS SUPPORTING STACKED BOTTLES

[75] Inventor: Maurice Beauchamp, St-Damien, Canada

[73] Assignee: IPL Inc., St. Damien, Canada

[21] Appl. No.: 99,000

[22] Filed: Jul. 29, 1993

[51] Int. Cl.[5] ..... B65D 21/02

[52] U.S. Cl. ..... 206/427; 108/55.3; 220/519; 206/821

[58] Field of Search ..... 108/55.3; 206/427, 430, 206/821; 220/512-514, 519

[56] References Cited

U.S. PATENT DOCUMENTS

| | | | |
|---|---|---|---|
| 3,160,306 | 12/1964 | Smalley | 220/512 |
| 3,391,814 | 7/1968 | Box | 220/519 |
| 4,615,444 | 10/1986 | de Larosiere | 206/564 |
| 4,653,651 | 3/1987 | Flum | 108/55.3 |
| 4,735,321 | 4/1988 | Day | 108/55.3 |
| 4,865,202 | 9/1989 | Day | 108/55.3 |
| 5,060,819 | 10/1991 | Apps | 206/509 |
| 5,188,233 | 2/1993 | Hammett | 206/427 |

*Primary Examiner*—Jimmy G. Foster
*Attorney, Agent, or Firm*—Quarles & Brady

[57] ABSTRACT

The disclosure herein describes a device for use with pallets supporting stacked bottles; it comprises a rectangular panel with a top face adapted to bear against part of a pallet undersurface and a bottom face adapted to sit on top of a number of the stacked bottles. The bottom face displays a series of recesses arranged in rows and columns to rest on the tops of the bottles; a number of these recesses include a contiguous cylindrical wall to define an inverted cup-shaped extension in which are received the top portion of the bottles to thereby secure the panel to the bottles on which it sits.

3 Claims, 3 Drawing Sheets

DEVICE FOR USE WITH PALLETS SUPPORTING STACKED BOTTLES

FIELD OF THE INVENTION

The present invention pertains to a device for use with pallets on which are supported stacked rows of bottles.

BACKGROUND OF THE INVENTION

At present, the stacking of bottles, such as soft drink polyteraftalate (PET) bottles, is accomplished by arranging on a pallet a number of plastic containers having compartments to receive the lower part of such bottles. For example, an arrangement of ten containers, each receiving eight bottles, is placed on a pallet. Then, a second row of ten bottle-receiving containers is positioned on the first row, the bottom wall of each bottle-receiving compartment of a container being shaped to sit on caps or mouths of the bottles located therebeneath. Once four rows of bottles are stacked, a second pallet is positioned on the upmost row. In order to protect the bottles of the last row, it is the usual practice to place, on top of some of the bottles of the last row, empty inverted containers so that the pallet being then positioned sits on the bottom faces of these inverted containers.

It has been found that these inverted plastic containers, not being made for this particular use, often break.

OBJECTS AND STATEMENTS OF THE INVENTION

It is an object of the present invention to overcome the above described problem associated with the present practice of stacking bottles in their containers on pallets.

The present invention is therefore concerned with providing a panel which is adapted to rest on a certain number of the bottles of the upmost row of stacked bottles while being adapted to receive the undersurface of a pallet laid thereon.

The present invention therefore relates to such device which consists of a rectangular panel having the top face adapted to bear against part of a pallet undersurface and a bottom face adapted to sit on top of a number of the stacked bottles; the bottom face displays a series of recesses arranged in rows and columns and configured to rest on tops of the bottles; a number of the recesses display a downwardly extending cylindrical wall defining an inverted cup-shaped extension in which is confined the top portion of a bottle so as to provide a secure arrangement of the panel on the bottles.

In one form of the invention, a cup- shaped extension is located at each corner of the rectangular panel.

The panel of the present invention is constructed so as to be stackable with similar panels when not being used for stacking bottles. Therefore, the cup-shaped extensions have their lower peripheral edges configured to correspondingly engage ribs which are displayed on the top face of an underlaid similar panel.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENT

Figure 1:
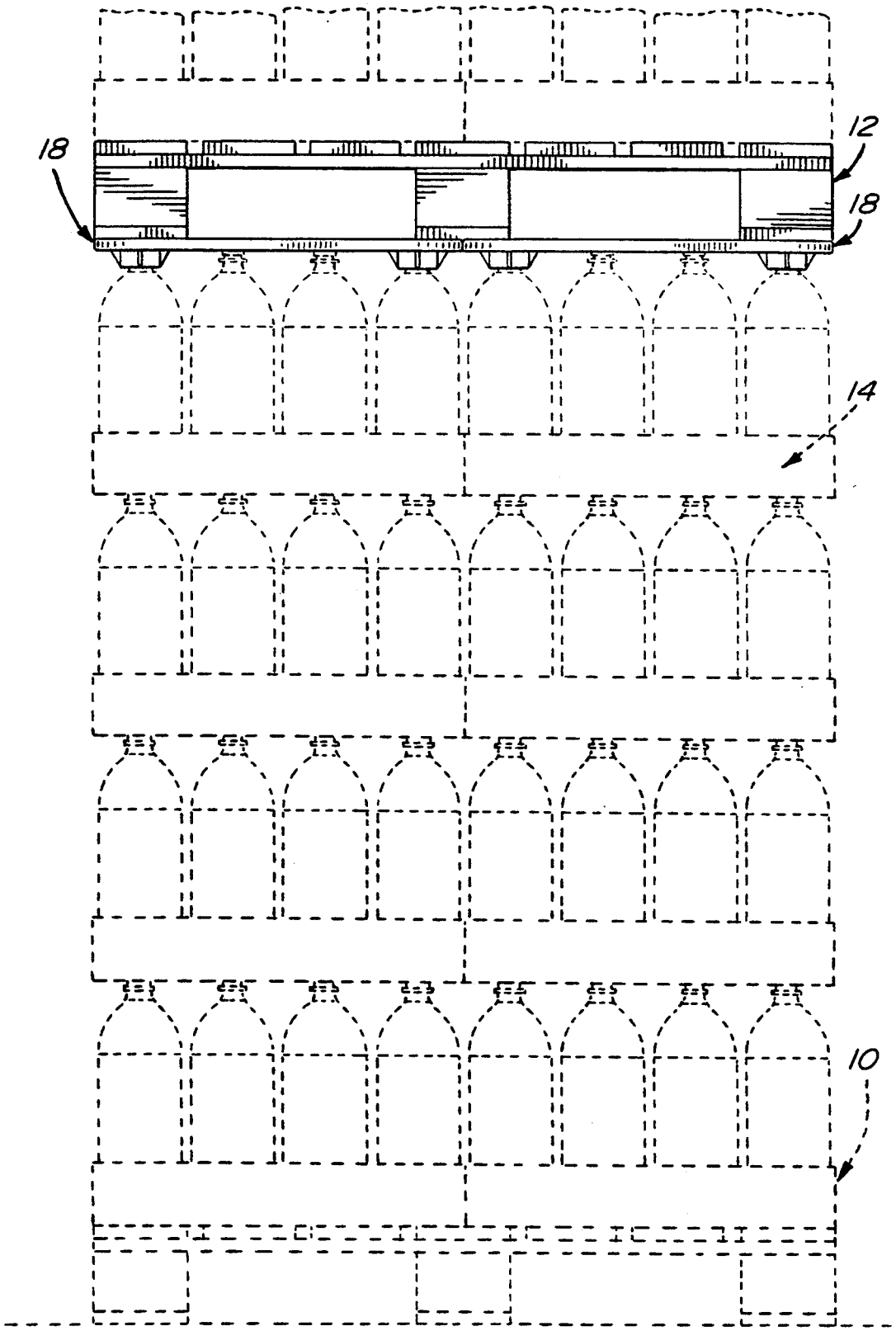
FIG. 1 is an elevational view of a stacked arrangement of bottles on pallets equipped with devices made in accordance with the present invention.

Referring to FIG. 1, there is shown an arrangement of stacked bottles wherein four rows of bottles are supported on a bottom pallet 10. A second pallet 12 is shown placed on the upmost row to receive additional rows of bottles.

The bottles usually have their lower portion confined in appropriate compartments of rectangular plastic containers 14; a compartment may have for example, an arrangement of two by four compartments. A row may have ten of these containers so that eighty bottles are in a row and three hundred and twenty bottles may be stacked between two pallets.

The present invention consists in providing a number of panels 18 between the upper pallet 12 and the arrangement of stacked bottles located therebeneath.

Figure 2:
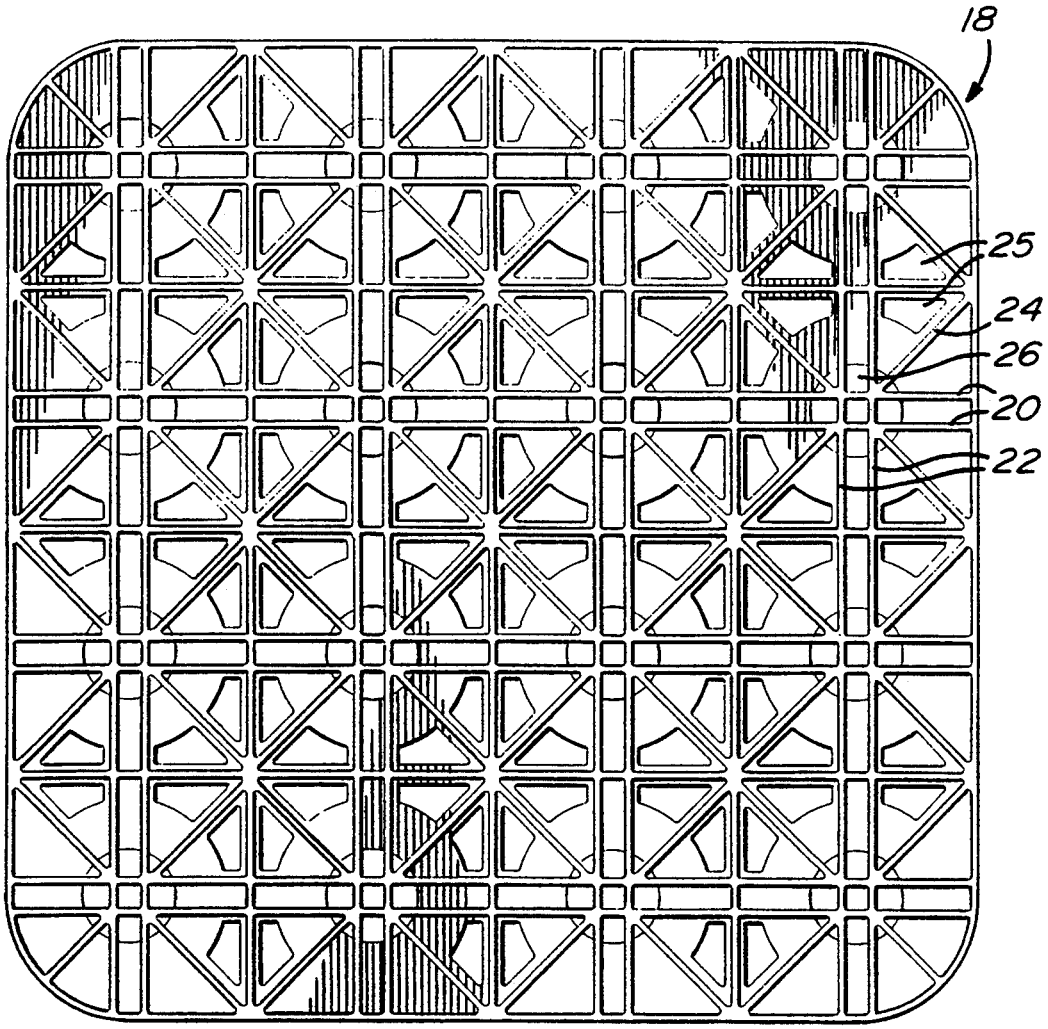
FIG. 2 is a top plan view of the device of the present invention.

Referring to FIG. 2, the panel has a top face formed of a series of horizontal ribs 20, vertical ribs 22 and oblique ribs 24. Gaps 25 are provided over the surface of the panel to reduce its weight.

The panel comprises a series of circular areas 26 arranged in rows and columns and having their center adapted to be positioned in alignment with the corresponding axis of bottles. On the bottom side, these areas 26 define concave recesses having a dimension so as to follow the contour of the top face of caps or to rest on the peripheral edge of the mouth of an empty bottle.

Figure 3:
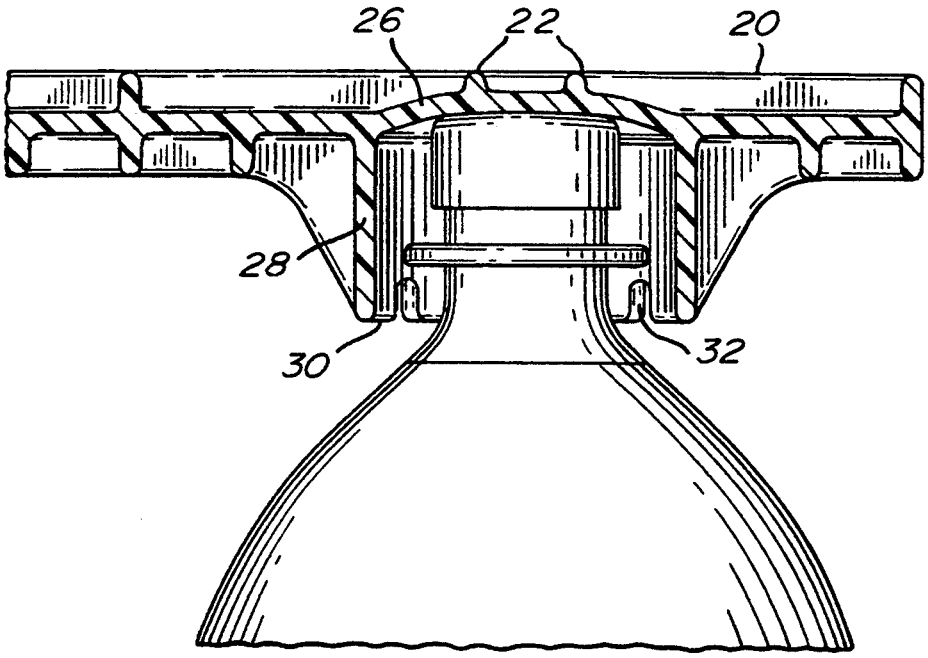
FIG. 3 is an enlarged cross sectional view showing the engagement of a corner area of the panel with the top area of a bottle.
Figure 4:
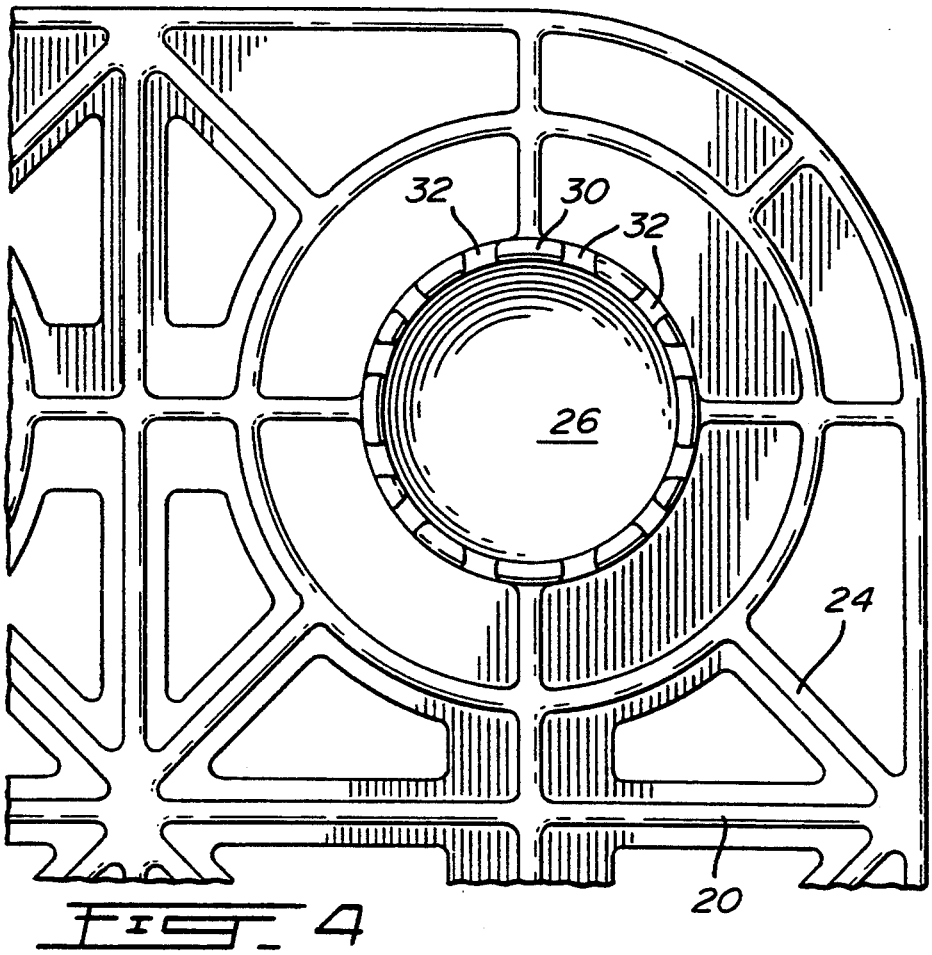
FIG. 4 is a bottom plan view of the corner area of the panel of the present invention.

Referring more particularly to FIGS. 3 and 4, there is provided, preferably at each corner of the panel and associated with a concave recess, a downward cylindrical wall 28. This cylindrical wall defines an inverted cup-shaped extension on the panel to assist in securing the panel once placed on bottles.

Figure 5:
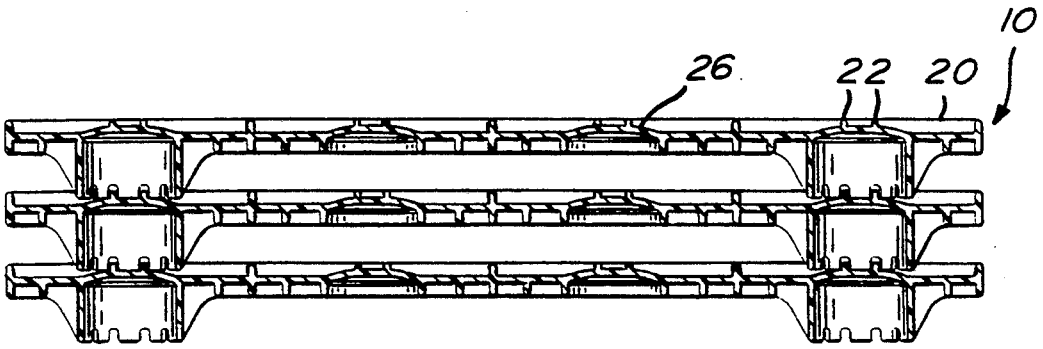
FIG. 5 is a cross-sectional view showing three stacked panels of the present invention; this figure is shown on the sheet illustrating FIG. 2.

One feature of the present invention is that, when the panels are not used for stacking, they are themselves stackable. The lower peripheral edge 30 of each extension is provided with a series of circumferentially spaced localizing grooves 32 which are so arranged as to receive therein the ribs 20, 22 and 24 of the top face of an underlaid panel (see FIG. 5).

The panel is made of a rigid molded plastic material, such as polyethylene.

Although the invention has been described above in relation to a specific form, it may be evident to a person skilled in the art that it may be modified and refined in various ways. For example, the bottles shown in the drawings are two liter soft drink bottles made of polyteraftalate (PET); other types of bottles could be used and the particular arrangement of recesses of the panel may be modified to suit their construction. It is therefore wished to have it understood that the present invention should not be limited in scope, except by the terms of the following claims.

I claim:

1. A device for use with pallets supporting stacked bottles, comprising:

a rectangular panel having a top face adapted to bear against part of a pallet undersurface and a bottom face adapted to sit on top of a number of the stacked bottles;

wherein said top face of said panel displays a series of ribs extending horizontally vertically and obliquely to one another;

wherein said bottom face displays a plurality of recesses arranged in rows and columns and configured to rest on tops of the bottles;

wherein a number of said recesses display a downwardly extending cylindrical wall defining an inverted cup-shaped extension to confine therein the top portion of a bottle so as to provide a secure arrangement of said panel on said bottles;

wherein said inverted cup-shaped extension is provided at each corner of the panel; and wherein said panel is stackable with correspondingly shaped panels; said cylindrical wall having a peripheral lower edge configured to inter-engage with the ribs on the top face of an underlaid panel.

2. A device as defined in claim 1, wherein said lower edge is configured with grooves corresponding in number and in shape to the ribs of an underlaid panel.

3. A device as defined in claim 1, wherein said panel is made of rigid molded plastic material.

* * * * *